United States Patent [19]

Cooper

[11] 4,274,090

[45] Jun. 16, 1981

[54] DETECTION OF ARTICLES IN ADJACENT PASSAGEWAYS

[75] Inventor: Michael N. Cooper, Flushing, N.Y.

[73] Assignee: Knogo Corporation, Hicksville, N.Y.

[21] Appl. No.: 122,807

[22] Filed: Feb. 19, 1980

[51] Int. Cl.[3] ..... G08B 13/24

[52] U.S. Cl. ..... 340/572; 340/505; 340/568

[58] Field of Search ..... 340/505, 552, 565, 567, 340/568, 572; 343/6.8 R, 6.5 SS, 7 R

[56] References Cited

U.S. PATENT DOCUMENTS

| | | | |
|---|---|---|---|
| 3,500,373 | 3/1970 | Minasy et al. | 340/572 |
| 3,707,711 | 12/1972 | Cole et al. | 340/572 |
| 3,818,472 | 6/1974 | Mauk et al. | 340/572 |
| 3,838,409 | 9/1974 | Minasy et al. | 340/572 |
| 4,118,693 | 10/1978 | Novikoff | 340/572 |
| 4,135,184 | 1/1979 | Pruzick | 340/572 |

*Primary Examiner*—Alvin H. Waring

*Attorney, Agent, or Firm*—Fitzpatrick, Cella, Harper & Scinto

[57] ABSTRACT

An article theft detection system for identifying which of two adjacent passageways a protected article passes. Each passageway is provided with spaced apart interrogation and receiver antennas, but a single receiver antenna services both passageways. Multiplexing is used to energize the interrogation antennas in alternate sequence. The single receiver antenna is connected to a single receiver whose output is connected through switches, synchronized with the interrogation multiplexing, to separate alarms for each passageway.

8 Claims, 3 Drawing Figures

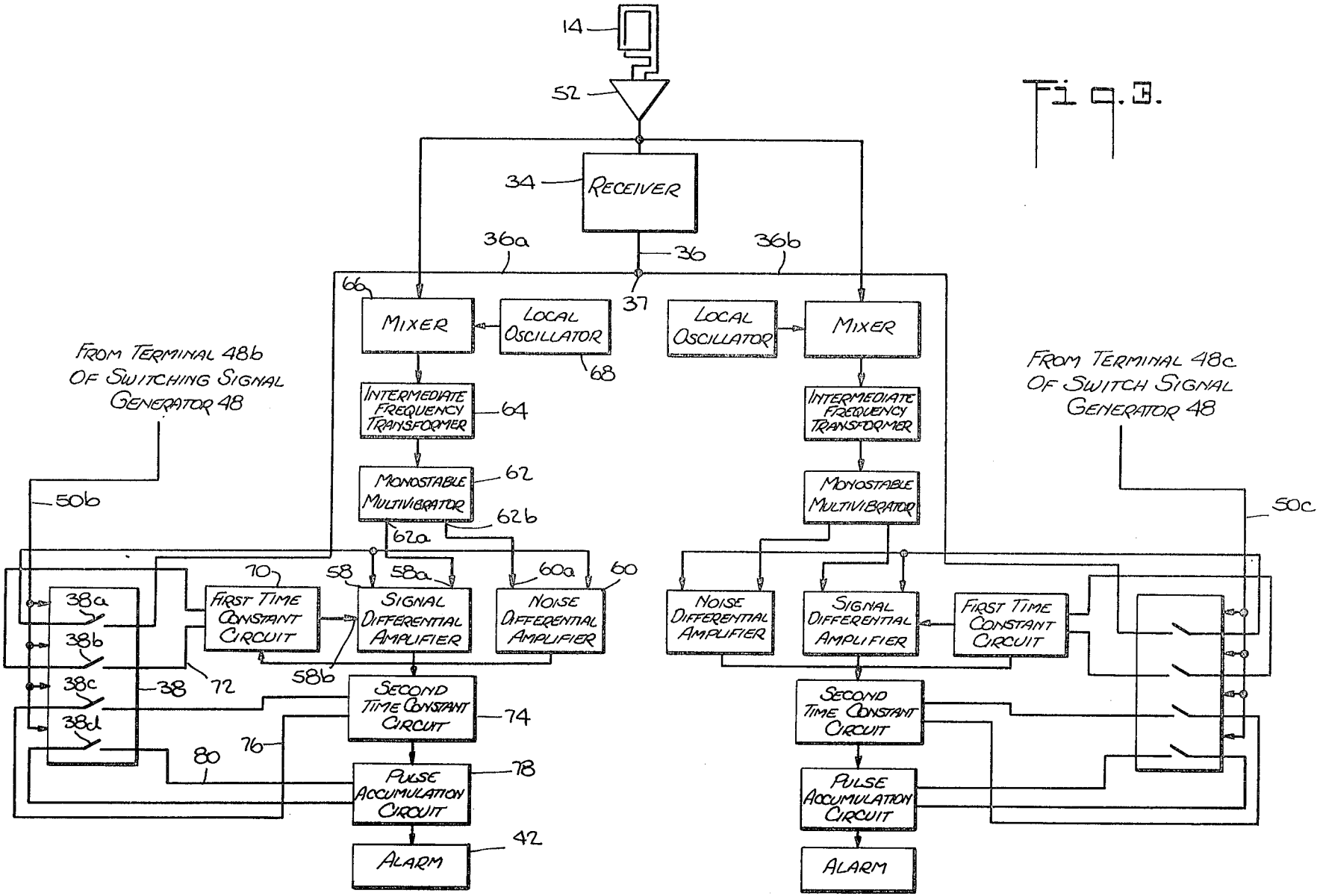
FIG. 3.
FROM TERMINAL 48c OF SWITCH SIGNAL GENERATOR 48
50c
FIRST TIME CONSTANT CIRCUIT
MIXER
INTERMEDIATE FREQUENCY TRANSFORMER
MONOSTABLE MULTIVIBRATOR
SIGNAL DIFFERENTIAL AMPLIFIER
SECOND TIME CONSTANT CIRCUIT
PULSE ACCUMULATION CIRCUIT
ALARM
LOCAL OSCILLATOR
NOISE DIFFERENTIAL AMPLIFIER
RECEIVER
14
52
34
36
36a
36b
37
LOCAL OSCILLATOR
68
60
60a
NOISE DIFFERENTIAL AMPLIFIER
MIXER
66
INTERMEDIATE FREQUENCY TRANSFORMER
64
MONOSTABLE MULTIVIBRATOR
62
62a
62b
SIGNAL DIFFERENTIAL AMPLIFIER
58
58a
58b
SECOND TIME CONSTANT CIRCUIT
74
PULSE ACCUMULATION CIRCUIT
78
ALARM
42
FIRST TIME CONSTANT CIRCUIT
70
72
76
80
38
38a
38b
38c
38d
FROM TERMINAL 48b OF SWITCHING SIGNAL GENERATOR 48
50b

DETECTION OF ARTICLES IN ADJACENT PASSAGEWAYS

BACKGROUND OF THE INVENTION

1. Field of the Invention

This invention relates to electronic theft detection and more particularly it concerns novel methods and apparatus for indicating the passageway through which protected goods are carried.

2. Description of the Prior Art

Prior art electronic theft detection systems of the type with which the present invention may be used are shown and described by way of example in U.S. Pat. No. 3,500,373 and No. 4,118,693.

In general, these prior systems make use of a transmitter antenna and a receiver antenna spaced apart from each other to define a passageway, usually at a doorway or other limited egress, through which a protected article may be carried. The protected article is provided with a "target" comprising a special electronic element or circuit capable of producing a characteristic electromagnetic signal in response to an electromagnetic field incident upon it. A transmitter is connected to the transmitter antenna and causes it to generate an interrogating electromagnetic field in the passageway. A receiver is connected to the receiver antenna and is designed to produce an alarm signal when a characteristic electromagnetic signal from a target in the passageway is received at the receiver antenna. The alarm signal is then used to activate a visual or acoustical alarm.

In some applications it is desirable to provide closely spaced passageways through which protected articles may be carried. A problem which arises in such cases is that the interaction of a target with interrogating fields in one passageway may cause electromagnetic signals to be produced and detected in adjacent passageways. The prior art discloses a technique for overcoming this problem. More specifically, as disclosed in U.S. Pat. No. 4,135,184, there are provided a plurality of individual, but closely spaced theft detection systems, each comprising its own set of transmitter and receiver antennas and associated transmitter, receiver and alarm. The antennas of each set extend horizontally and are vertically spaced apart from each other, with one on the floor and the other overhead of the passageway. Each system is provided with a multiplexing arrangement which permits only one system to be in operation at any one time. By switching the multiplexing arrangement very rapidly the various passageways are interrogated in succession and it becomes possible to ascertain the particular passageway through which a target is being carried.

The multiplexing technique described above has been successful with horizontal antenna arrangements as described above. Problems have arisen however in applying this technique to vertical antennas, i.e. antennas which extend in vertical planes and which are horizontally spaced apart. Multiple adjacent passageways utilizing vertical antennas are formed by positioning one pair of spaced apart transmitter and receiver antennas adjacent to a second pair of spaced apart transmitter and receiver antennas. Where only two adjacent passageways are to be provided, one may employ a single continuously operating transmitter antenna and two receiver antennas on opposite sides of and spaced apart from the transmitter antenna to form two adjacent passageways. In such case a single, continuously operating transmitter is used to continuously energize the transmitter antenna. Further, separate receivers and alarms are connected to the two receiver antennas; and multiplexing is used to render only one receiver and alarm active at a time.

While the foregoing prior art arrangements have been suitable for avoiding ambiguities when vertical antennas are used to form two adjacent passageways, problems arise when a third passageway is to be added because in such case the third passageway requires the provision of a second transmitter and a third receiver. Consequently, it becomes necessary to position an antenna of one passageway defining pair at a location immediately adjacent an antenna from another passageway defining pair. Although multiplexing may be used in such case to identify which passage a protected article is carried through other problems arise due to the vertical orientation of the antennas. More particularly it has been found that when antennas of different passageway defining pairs are positioned adjacent each other their circuits cross couple and the inactive antenna imposes a load on the active antenna which severely restricts its effectiveness. It has been proposed to use the multiplexing in a way to disconnect the inactive antenna from its circuit; however this becomes quite expensive and the switching action itself causes transients which could interfere with the system.

SUMMARY OF THE INVENTION

The present invention overcomes the above described problems of the prior art and permits the use of vertical antennas to form several adjacent passageways without the deleterious effects of cross-coupling between adjacent antennas.

According to one aspect of the present invention there is provided an article theft detection system comprising transmitter means including first and second vertically extending, horizontally spaced apart transmitter antennas for producing electromagnetic interrrogation signals, receiver means including a single vertically extending receiver antenna positioned between the first and second transmitter antennas to define first and second adjacent passageways each extending between the receiver antenna and a different one of the transmitter antennas so that each passageway has produced therein the interrogation signal from its associated transmitter. An electronic target, capable of being mounted on an article, is also provided; and this target comprises an electrical device which, when present in one of the passageways, reacts with the interrogation signal therein to produce predetermined electromagnetic disturbances at the receiver antenna. The receiver means is responsive to those disturbances to produce electrical alarm signals. There are also provided first and second alarm means each being operable to produce a recognizable alarm in response to applied electrical alarm signals and there are further provided first switching means arranged to cause the first and second transmitter antennas to produce the interrogation signals alternately during successive time intervals and further switching means connected to direct the electrical alarm signals to operate the first and second alarms alternately during the successive time intervals.

According to a further aspect of the present invention, there is provided a novel method of detecting which of two closely positioned passageways a protected article passes through. This novel method comprises the steps of generating electromagnetic interrogation signals in the two passageways alternately during successive time intervals, providing on the protected articles targets capable of producing predetermined electromagnetic disturbances when exposed to the interrogation signals in the passageways, passing the targets through the passageways, receiving the electromagnetic disturbances produced by the targets in both passageways at a single receiver antenna positioned between the passageways, generating alarm signals in response to the received electromagnetic disturbances and directing the generated alarm signals to different alarms during the successive time intervals.

The apparatus and method of the present invention permit closely spaced passageways to be monitored using a multiplex technique while at the same time avoiding the loading or cross coupling effects which occur when antennas from two adjacent detection systems are placed next to each other.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A selected embodiment of the invention has been chosen for purposes of illustration and description, and is shown in the accompaying drawings, forming a part of the specification, wherein:

FIG. 3 is a further block diagram illustrating in greater detail a preferred embodiment of the invention.

DETAILED DESCRIPTION OF THE PREFERRED EMBODIMENT

Figure 1:
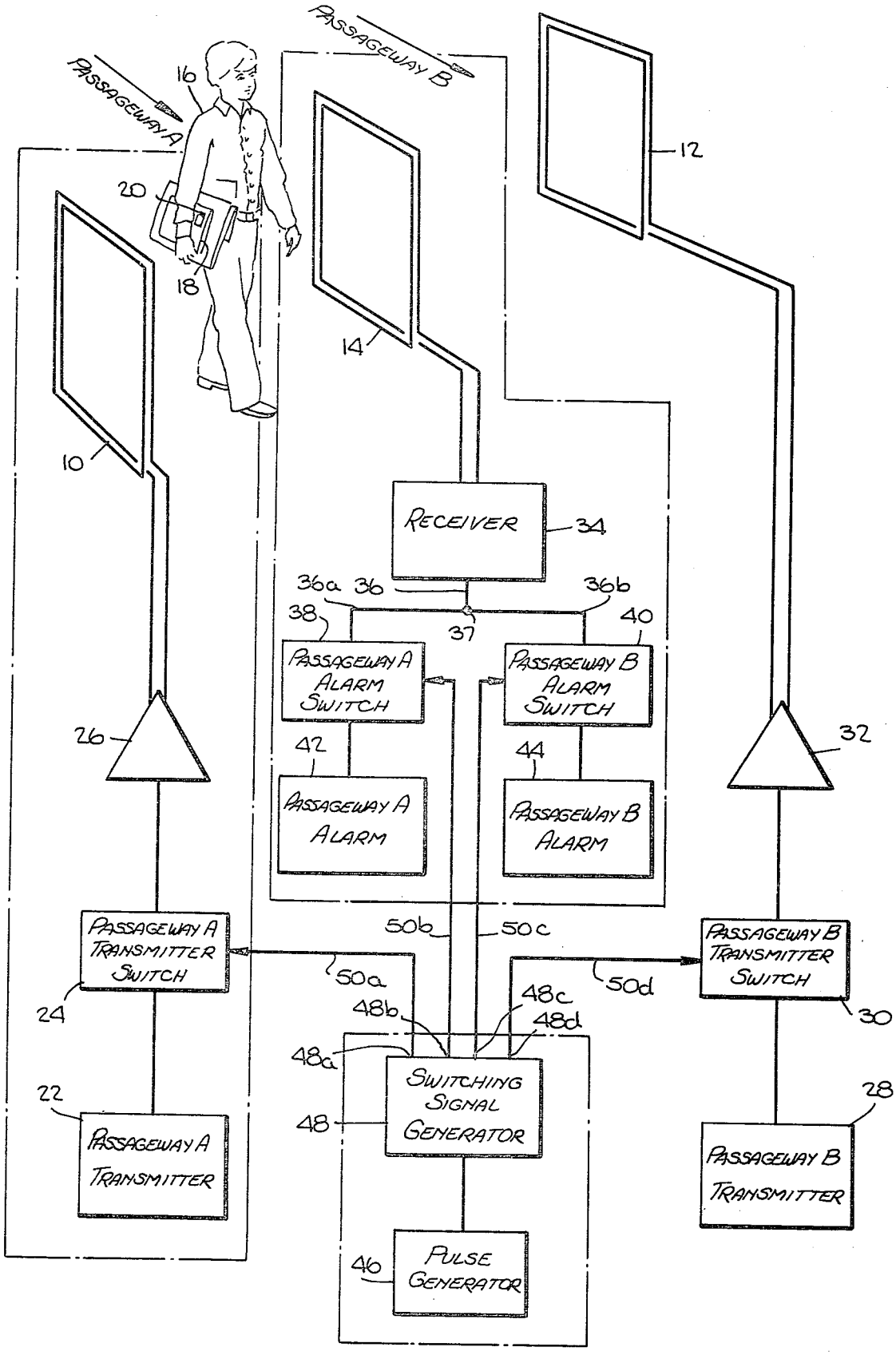
FIG. 1 is a block diagram of an electronic theft detection system in which the present invention is embodied.

The electronic theft detection system of FIG. 1 includes a pair of horizontally spaced apart transmitter antennas 10 and 12 in the form of vertically extending loops and a single receiver antenna 14, also in the form of a vertically extending loop. The receiver antenna 14 is positioned intermediate the two transmitter antennas 10 and 12 to define a pair of adjacent passageways A and B through either of which a person 16 carrying a protected article, such as an article of merchandise 18, may pass upon exiting from a protected area (not shown). The protected merchandise 18 has mounted thereon a target 20 which is capable of disturbing an interrogating electromagnetic field generated in the passageway, A or B, through which the target is carried, and thereby produce a characteristic electromagnetic disturbance at the receiver antenna 14. The specific nature of the target 20 depends upon the nature of the signals used in interrogation and detection. In one case, where the system uses detection principles described in U.S. Pat. No. 3,500,373, the target 20 may comprise a resonant electrical circuit; and the interrogating electromagnetic field has a varying frequency which sweeps back and forth across the resonance frequency of the target; this produce a series of characteristic disturbances at the receiver antenna which are detected. In another case, where the system uses detection principles described in U.S. Pat. No. 4,118,693, the target may comprise a thin elongated strip of easily saturable magnetic material, such as permalloy. This reacts to an interrogating electromagnetic field at one frequency to produce disturbances at several, harmonically related frequencies. These harmonically related disturbances are received at the receiver antenna and detected.

A passageway A transmitter 22 is provided to generate interrogation signals appropriate to the type of target 20 to be detected. The output from this transmitter is connected through a passageway A transmitter switch 24 to a passageway A amplifier 26 where the output is amplified and directed to the interrogation antenna 10. The interrogation antenna 10 is energized by the transmitter output and generates a corresponding interrogating electromagnetic field in the passageway A. In the same manner, a passageway B transmitter 28 is also provided and the output of this transmitter is connected through a passageway B transmitter switch 30 to a passageway B amplifier 32 and is directed to the interrogation antenna 12. The antenna 12 thus generates an interrogating magnetic field in the passageway B.

The single receiver antenna 14 is connected to a receiver 34. The receiver 34 is of a construction suitable for detection of the characteristic signals produced at the antenna 14 by the presence of the target 20. That is, where the target 20 is a resonant circuit and the system is of the type described in U.S. Pat. No. 3,500,373, the receiver 34 operates to produce an alarm actuation signal at an alarm line 36 when there occur a series of pulse-like field disturbances at the receiver antenna corresponding to the successive passage of a swept frequency interrogation field through the resonant frequency of the target. On the other hand, where the target 20 is of a permalloy material and the system is of the type described in U.S. Pat. No. 4,118,693, the receiver 34 operates to produce an alarm actuation signal at the alarm line 36 when there occurs a field disturbance at the receiver antenna in the form of a predetermined harmonic of the frequency of the interrogation signal.

The alarm line 36 extends from the receiver 34 to a branch junction 37; and it there splits into two branch lines **36*a* and 36*b*, connected respectively through a passageway A alarm switch 38 and a passageway B alarm switch 40, to a passageway A alarm 42 and a passageway B alarm 44. The alarms 42 and 44 may be any well-known device capable of providing a visual or audible signal in response to the presence of a signal on its respective alarm line 36*a* and 36*b***.

A multiplexing arrangement is also provided in the system of FIG. 1. This multiplexing arrangement comprises a pulse generator 46 and a switching signal generator 48. The pulse generator 46 may be any electronic device, such as an oscillator or an astable multivibrator, capable of generating a succession of pulses which are applied to the switching signal generator 48. The switching signal generator in turn includes a sequencing device, such as a counter, and timing circuits to convert the pulse inputs to a series of timed switching signals on four switch activation terminals **48*a*, 48*b*, 48*c* and 48*d***.

These signals are transmitted via associated switch activation lines 50*a*, 50*b*, 50*c* and 50*d* to the passageway A transmitter switch 24, the passageway A alarm switch 38, the passageway B transmitter switch 30 and the passageway B alarm switch 40.

Figure 2:
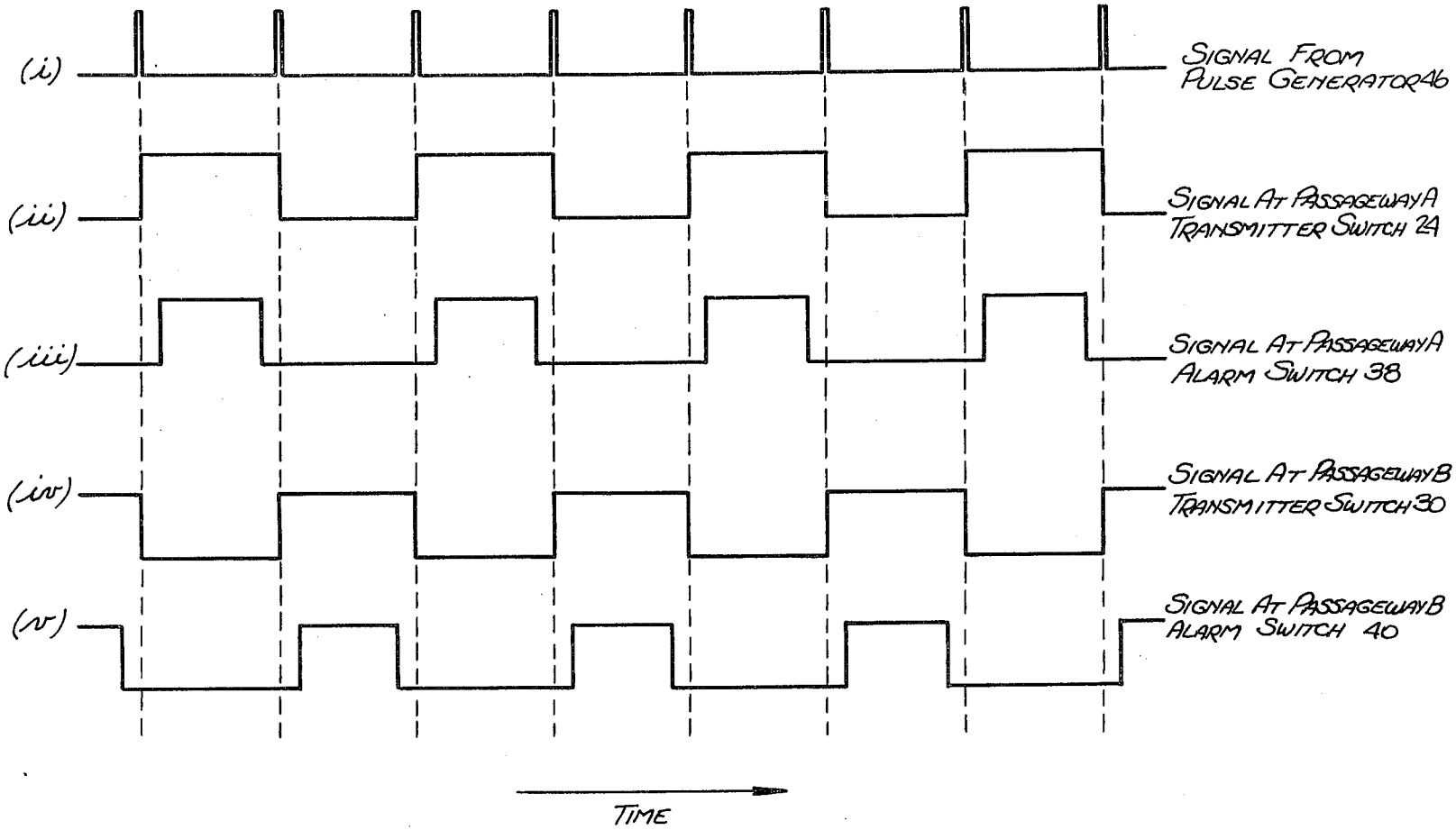
FIG. 2 is a series of waveforms illustrating the operation of the system of FIG. 1.

The timing of the switching signals produced at the terminals 48*a–d* and on the switch activation lines 50*a–d* is illustrated in FIG. 2. The uppermost curve (i) illustrates the signal output of the pulse generator 46. As can be seen, this signal is in the form of a series of pulses equally spaced in time. These signals control the operation of the switching signal generator 48. Curves (ii) and (iv) represent the output at the switch activation terminals 48*a* and 48*c* respectively. These outputs, as can be seen, are regular recurring on-off signals of equal duration but occurring alternately with respect to each other. Curves (iii) and (v) represent the output at the switch activation terminals 48*b* and 48*d* respectively. These outputs are also on-off signals and are synchronized with the on-off signals at the respective terminals 48*a* and 48*c* (curves ii and iv) respectively. However the signals at the terminals 48*b* and 48*d* are in the on state only during a central portion of the duration that the signals at their respective terminals 48*a* and 48*c* are in the on state. The specific circuits used to convert the output of the pulse generator 46 to the described outputs of the switching signal generator 48 are not critical to the invention and those skilled in the art will readily understand how such device might be constructed.

In operation of the device of FIG. 1, the pulse generator 46 operates the switching signal generator 48 to energize its output terminals 48*a–d* in accordance with curves (ii)–(v) of FIG. 2. These signals are applied via the associated switch activation lines 50*a–d* to operate the passageway A transmitter and alarm switches 24 and 38 and the passageway B transmitter and alarm switches 30 and 40. As a result these switches are operated in accordance with curves (ii)–(v) of FIG. 2. The passageway A transmitter 22 is thus enabled to energize the transmitter antenna 10 during one half of a switching cycle while the passageway B transmitter 28 is enabled to energize the transmitter antenna 12 during the remaining one half of the switching cycle.

Electromagnetic fields generated in both passageways A and B from the two transmitter antennas 10 and 12, as well as the distinctive field disturbances produced by a target 20 in either or both of the passageways, are applied to the receiver antenna 14 and are detected in the receiver 34. Whenever a target is present in either of the passageways A and B the receiver detects the resultant distinctive field disturbances caused by the target and it produces an alarm signal on the two branches 36*a* and 36*b* of the alarm line 36. Whenever either alarm switch 38 or 40 is actuated, the alarm signal passes through from the corresponding branch 36*a* or 36*b* to actuate the associated alarm 42 or 44.

It will be appreciated from FIG. 2 that because of the switching sequence, the alarm 42 may be actuated only during the switching cycle interval that an interrogation signal is being generated in the passageway A by the interrogation antenna 10, while the alarm 44 may be actuated only during the switching cycle interval that an interrogation signal is being generated in the passageway B by the interrogation antenna 12. Consequently if a target 20 is being carried through passageway A the alarm 42 will be actuated during the first half of a switching cycle when the transmitter antenna 12 is being energized and the passageway A alarm switch 38 is actuated. However, during the following half cycle, when the transmitter 14 is being energized to produce an interrogation signal in passageway B no alarm signal is produced because no target is present in passageway B. Thus, with this arrangement, a target which passes through passageway A will cause actuation of only the alarm 42, a target which passes through passageway B will cause actuation of only the alarm 44 and targets which pass through both passageways A and B will cause actuation of both alarms 42 and 44.

As can be seen from FIG. 2, the alarm switches 38 and 40 are not actuated during the full duration that their associated transmitter switches 24 and 30 are actuated. Instead they are actuated only during the central portion of the interval during which their respective transmitter switches are actuated. The purpose for this is to ensure that before either passageway alarm is made operative, the transmission of interrogation signals in the other passageway has terminated and that interrogation signals have begun to be generated in the passageway corresponding to that alarm. This reduces the likelihood of an alarm corresponding to one passageway being actuated by the presence of a target in an adjacent passageway.

It will be appreciated that the above described system employs only a single receiver antenna 14 and a single receiver 34 to detect the movement of target through two passageways. Because of this the system is free of cross coupling which occur when other antennas are located adjacent an active receiver antenna.

FIG. 3 shows the application of the principles of the present invention to a swept frequency resonant circuit detection system of the type shown and described in U.S. Pat. No. 3,500,373 as used with a false alarm prevention feature as shown and described in U.S. Pat. No. 3,868,669. In FIG. 3 only the single receiver antenna 14 is shown, it being understood that a pair of transmitter antennas are provided as described in conjunction with FIG. 1; and it further being understood that the transmitter antennas are energized during alternate intervals by signals whose frequency varies cyclically.

In the system of FIG. 3 the receiver antenna 14 is connected through a pre-amplifier 52 to the receiver 34. The receiver 34 includes a detector and amplifier and filter circuits as described in U.S. Pat. No. 3,500,373.

The output of the receiver 34 is transmitted along the line 36 to the branch junction 37 and the branch lines 36*a* and 36*b* to alarm switching, noise rejection and alarm actuation circuits to be described. As can be seen, the alarm switching, noise rejection and alarm actuation circuits for each branch are the same; and accordingly the components of only one branch will be described herein.

As can be seen in FIG. 3, the branch signal line 36*a* extends from the junction 37, through a first switch stage 38*a* of the alarm switch 38 and into a signal differential amplifier 58 and a noise differential amplifier 60. As described below, these differential amplifiers are switched to be operative in alternate sequence during different portions of the frequency sweep cycle of the interrogation signal. By way of example, the interrogation signal may have a frequency which varies cyclically from 1.95 to 2.05 megahertz at a rate of three hundred cycles per second. In such case the targets 20 are resonant only to frequencies close to two megahertz. Thus during those portions of the frequency sweep cycle when the interrogation signal is close to two megahertz the signal differential amplifier 58 is in its operative condition but the noise differential amplifier 60 is inoperative. During the remaining portions of the frequency sweep cycle, i.e. when the interrogation signal frequency is not at two megahertz, the signal differential amplifier is inoperative and the noise differential amplifier is operative. The signal differential amplifier 58 constitutes a signal channel through which receiver outputs pass during one portion of a frequency sweep cycle and the noise differential amplifier 60 constitutes a noise channel through which receiver outputs pass during the remaining portions of the frequency sweep cycle.

The switching of the signal and noise differential amplifiers to their operative and inoperative states in alternate sequence is acheived by means of a monostable multivibrator 62 whose outputs 62*a* and 62*b* are connected to enable terminals 58*a* and 60*a* of the signal and noise differential amplifiers. The monostable multivibrator 62 in turn is triggered by the output of an intermediate frequency transformer 64 when that output coincides with the passing of the interrogation signal into the resonance range of the targets 20. The intermediate frequency transformer 64 recieves signals from a mixer 66 which in turn receives signals from a local oscillator 68 and from the preamplifier 52. The mixer uses the local oscillator signal to transform the interrogation signal received at the receiver antenna 14 into an intermediate frequency range which still includes a frequency sweep corresponding to that produced at the transmitter. This frequency swept intermediate frequency signal is sensed by the intermediate frequency transformer 64 which itself has a frequency sensitivity such that when the applied frequency approaches that corresponding to the resonance range of the target 20, the output of the intermediate frequency transformer 64 is high enough to trigger the monostable multivibrator 62. The monostable multivibrator remains triggered for a period of time corresponding to the duration in which the interrogation signal is sweeping through the resonance range of the target 20; and then it reverts to its untriggered state. As indicated above the monostable multivibrator 62, when triggered, produces output signals which place the signal differential amplifier in the operative state and the noise differential amplifier in the inoperative state, and when the monostable multivibrator reverts to its non-triggered condition its output signals place the noise differential amplifier in the operative state and the signal differential amplifier in the inoperative state.

The specific construction of the signal and noise differential amplifiers 58 and 60, the monostable multivibrator 62, the intermediate frequency transformer 64, the mixer 66 and the local oscillator 68 is not given here as these circuits individually do not per se constitute the present invention, and their specific construction is not critical to the invention. Suitable circuits for these components are found in the prior art, in particular, equipment sold by Knogo Corporation of Westbury, N.Y. as the Knogo Satellite (TM) anti-pilferage system.

The output of the noise differential amplifier 60 is connected to a first time constant circuit 70. Whenever the noise differential amplifier circuit produces an output above a predetermined noise threshold level, its output is maintained by the time constant circuit 70 for a predetermined length of time, usually equivalent to the duration of several frequency sweeps. This output is applied to a disable gate terminal 58*b* of the signal differential amplifier to prevent this amplifier from operating for the predetermined duration of several frequency sweeps. Thus during this duration the signal differential amplifier 58 does not produce an output even during those periods of time when the interrogation signal is sweeping through the resonance range of the target 20. It can be seen that when a high noise level is detected during those portions of the frequency sweep outside the resonance range of the target, the noise differential amplifier and first time constant circuit deactivate the signal differential amplifier 58 for the duration of several successive frequency sweeps, to prevent any alarm from occurring. After the several sweep duration, which is controlled by the time constant circuit 70, its output is removed from the disable gate terminal 58*b* of the signal differential amplifier to permit it again to resume operation, which it will do until a high noise level is again detected by the noise differential amplifier 60. The specific construction of the time constant circuit 70 is not critical to this invention and it may comprise any well known electrical timing device capable of maintaining an output signal for a predetermined duration (e.g. several frequency sweeps) following application of an input signal. In the present case the time constant circuit 20 may comprise a capacitor which is charged by an input signal from the differential amplifier 70, and a resistor connected to the capacitor to permit it to discharge slowly at a predetermined rate. The charge on the capacitor is applied to the disable terminal 58*b* of the signal differential amplifier 58.

Because of the multiplexing used in the present invention, the system may switch from interrogation of passageway A to interrogation of passageway B while the signal differential amplifier 58 for passageway A is being maintained in the inoperative state by the first time constant circuit 70. Since the noise which caused the deactivation of the amplifier 58 may be specific to passageway A, it is preferred that the time duration of inoperativeness of the amplifier 58 be extended by an amount of time equal to that when other passageways are being interrogated. For this purpose the first time constant circuit 70 is connected via a wire 72 to a second switch stage 38*b* of the alarm switch 38. When the second stage 38*b* is open it interrupts the timing operation, e.g. by disconnecting the discharge path of the capacitor in the time constant circuit, for the duration in which other passageways are being monitored so that the charge is held until the passageway at which noise was detected is again monitored. At this time the second switch stage 38*b* closes and the timing resumes.

The output of the signal differential amplifier 58 is applied to a second time constant circuit 74 which has a time constant slightly longer than the duration between successive pulses produced by a resonant target being swept by the interrogation signal. The time constant circuit 74 will permit pulses to pass through to its output only if those pulses continues in sequences. However if a pulse is skipped then the time constant circuit will discharge and a following pulse will not pass through. The time constant circuit 74 may be any timing circuit which will pass pulses when they continue to occur at a regular repetition rate but which will discharge in the absence of a pulse in the sequence and will not begin to pass pulses again until a new sequence begins. The circuit, for example, may comprise a capacitor and a resistor connected in parallel across a pair of pulse supply terminals with the R-C time constant of the capacitor and resistor being slightly greater than the pulse repetition rate produced by the target 20. In order not to have the multiplexing action give the effect of a missing pulse when a different passageway is being monitored, the second time constant circuit 74 is connected via a wire 76 to a third switch stage 38*c* of the alarm switch 38. This third stage, when opened, disconnects the capacitor in the time constant circuit from its discharge path so that the capacitor does not discharge while the system is interrogating another passageway. Thereafter, when the system resumes interrogation of the first passageway the time constant circuit 74 will immediately begin to pass detected pulses.

The pulses passed by the second time constant circuit 74 are supplied to a pulse accumulation circuit 78 which also contains a capacitor arranged to accumulate pulses and build up a charge proportioned to the number of pulses accumulated. When the accumulated charge reaches a predetermined threshold the pulse accumulation circuit applies an actuation signal to the alarm 42. The pulse accumulation circuit 78 also contains a resistive discharge path from the pulse accumulation capacitor so that the capacitor will become reset to begin a new pulse accumulation if no pulses are supplied to it for a predetermined length of time. In order to prevent this discharge from occuring during multiplexing the discharge path of the pulse accumulation circuit 78 is connected, via a wire 80 to a fourth switch stage 38 of the alarm switch 38. This fourth switch stage, when open during interrogation of other passageways, keeps the discharge path disconnected from the pulse accumulation capacitor and thereby retains its accumulated charge while another passageway is being monitored. Thereafter, when the first passageway is again monitored and switching stage 38*d* is again closed, the accumulation of pulses does not begin anew but is merely resumed.

The various stages of the alarm switch 38 may be combined in a single integrated circuit to which the switch actuation line 50*b* from the switching signal generator is connected so that all of the switch stages is opened and closed together.

It is to be understood that, the multiplexing arrangements, the noise signal monitoring and the time constant arrangements described herein are all in the prior art and no novelty is claimed for these arrangements per se.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. An article theft detection system for identifying which of two closely positioned passageways a protected article passes through, said system comprising transmitter means including, first and second transmitter antennas for producing electromagnetic interrogation signals in the vicinity thereof, receiver means including a single receiver antenna positioned between said first and second transmitter antennas to define first and second adjacent passageways each extending between said receiver antenna and a different one of said transmitter antennas so that each passageway has produced therein the interrogation signal for its associated transmitter antenna, at least one electronic target capable of being mounted on an article for protecting said article, said target comprising an electrical device which, when present in one of said passageways, reacts with the interrogation signal therein to produce predetermined electromagnetic disturbances at said single receiver antenna, said receiver means being responsive to said predetermined electromagnetic disturbances to produce electrical alarm signals at a receiver output, first and second alarm means each being operable by said electrical alarm signal to produce a recognizable alarm, first switching means arranged to cause said first and second transmitter antennas to produce said interrogation signals alternately during successive time intervals, and further switching means connected between the receiver output and said first and second alarm means to apply receiver outputs, including said alarm signals, to said first and second alarm means alternately during said successive time intervals.

2. An article theft detection system according to claim 1 wherein the transmitter antennas each extend vertically and are spaced apart horizontally.

3. An article theft detection system according to claim 1 wherein said first switching means comprises first and second transmitter switches connected to control the energization of said first and second transmitter antennas respectively, wherein said further switching means comprises first and second alarm switches connected to control the application of said receiver outputs, including said alarm signals, to said first and second alarm means respectively, and wherein said first alarm switch is connected to be operated during the interval of operation of said first transmitter switch and said second alarm switch is connected to be operated during the interval of operation of said second transmitter switch.

4. An article theft detection system according to claim 3 wherein said first and further switching means comprise a switching signal generator which produces first and second transmitter switch actuation signals in alternate sequence at first and second transmitter switch actuation output terminals respectively, and which further produces, at a first alarm switch actuation output terminal, a first alarm switch actuation signal during the interval of each first transmitter switch actuation signal and which produces, at a second alarm switch actuation output terminal, a second alarm switch actuation signal during the interval of each second transmitter switch actuation signal, said first and second transmitter switch acutation output terminals being connected to said first and second transmitter switches respectively and said first and second alarm switch actuation output terminals being connected to said first and second alarm switches respectively.

5. An article theft detection system according to claim 1 wherein said transmitter means produces in each passageway interrogation signals whose frequency is swept cyclically, wherein said targets comprise resonant electrical circuits whose resonance frequency is within the range of frequencies over which the interrogation signals are swept, wherein said receiver means produces at its output pulses in response to the electromagnetic disturbances which occur as the interrogation signals sweep through the resonant frequency of a target in one of the passageways, wherein the alarm means corresponding to each passageway includes a pulse accumulation circuit for accumulating applied pulses from said receiver means and for producing an alarm output in response to the accumulation of a predetermined number of said applied pulses within a predetermined length of time and wherein said further switching means includes a switch connected to said pulse accumulation circuit to interrupt its timing and maintain the pulses accumulated therein during intervals in which receiver outputs are not being applied to its respective alarm means.

6. An article theft detection system according to claim 5 wherein each of said alarm means includes a noise channel and a signal channel each arranged to receive outputs from said receiver means during a different portion of each frequency sweep cycle occurring during the interval in which receiver outputs are being applied to said alarm means, the output of each signal channel being connected to supply the pulses from said receiver means to the pulse accumulator circuit of its respective alarm means, wherein each of said alarm means further includes a time constant circuit connected to receive outputs from its associated noise channel and to disable its associated signal channel from supplying pulses for a predetermined length of time following the occurrence of a predetermined output from said noise channel and wherein said further switching means includes a switch connected to said time constant circuit to interrupt its timing during intervals in which receiver outputs are not being applied to its respective alarm means, whereby the timing duration of said time constant circuit is effectively extended by the length of said intervals.

7. A method of detecting which of two closely positioned passageways a protected article passes through, said method comprising the steps of generating electromagnetic interrogation signals in the two passageways alternately during successive time intervals, providing on the protected articles targets capable of producing predetermined distinctive electromagnetic disturbances when exposed to said interrogation signals in the passageways, passing said protected articles through said passageways, receiving the electromagnetic disturbances produced by targets in both passageways at a single receiver antenna positioned between said passageways, generating alarm signals in response to the received electromagnetic disturbances, directing the generated alarm signals to different alarms during said successive time intervals and operating each alarm in response to alarm signals directed thereto, whereby the electromagnetic disturbances produced by the presence of a target in one passageway cause the actuation of one alarm and the electromagnetic disturbances produced by the presence of a target in the other passageway cause the actuation of another alarm.

8. A method according to claim 7 wherein said electromagnetic disturbances are generated at a pair of vertically extending spaced apart transmitter antennas positioned on opposite sides of said single receiver antenna.

* * * * *